US009131314B2

(12) United States Patent
Hattori et al.

(10) Patent No.: US 9,131,314 B2
(45) Date of Patent: Sep. 8, 2015

(54) ACOUSTIC SYSTEM

(75) Inventors: Hisao Hattori, Osaka (JP); Junsei Sato, Osaka (JP); Chanbin Ni, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 307 days.

(21) Appl. No.: 13/808,342

(22) PCT Filed: Jun. 24, 2011

(86) PCT No.: PCT/JP2011/064545

§ 371 (c)(1),
(2), (4) Date: Jan. 4, 2013

(87) PCT Pub. No.: WO2012/005122

PCT Pub. Date: Jan. 12, 2012

(65) Prior Publication Data

US 2013/0101144 A1 Apr. 25, 2013

(30) Foreign Application Priority Data

Jul. 7, 2010 (JP) ..... 2010-154858

(51) Int. Cl.

| | |
|---|---|
| ***H04R 3/00*** | (2006.01) |
| ***H04R 3/12*** | (2006.01) |
| ***H04R 1/40*** | (2006.01) |
| ***H04R 1/24*** | (2006.01) |

(52) U.S. Cl.

CPC .. *H04R 3/12* (2013.01); *H04R 1/24* (2013.01); *H04R 1/403* (2013.01); *H04R 2201/403* (2013.01); *H04R 2201/405* (2013.01); *H04R2430/01* (2013.01); *H04S 2400/11* (2013.01); *H04S 2400/13* (2013.01); *H04S 2400/15* (2013.01); *H04S 2420/13* (2013.01)

(58) Field of Classification Search

CPC .... H04R 1/403; H04R 3/12; H04R 2201/403; H04R 2499/13; H04R 5/02; H04R 1/24; H04R 1/26; H04R 17/00; H04R 29/001; H04R 19/02; H04R 19/013; H04R 2430/01; H04R 3/00; H04R 3/04; H04R 1/22; H04R 1/40; H04R 2201/107; H04R 2420/05; H04R 3/14; H04R 5/00; H04M 9/08

USPC ..... 381/59, 85, 86, 96, 97, 111, 116, 117, 381/182, 332, 300, 330; 379/388.02, 379/420.01, 420.02

See application file for complete search history.

(56) References Cited

U.S. PATENT DOCUMENTS

2005/0201583 A1* 9/2005 Colich ..... 381/335
2008/0212805 A1* 9/2008 Fincham ..... 381/160

FOREIGN PATENT DOCUMENTS

JP 2006-67301 A 3/2006

OTHER PUBLICATIONS

Official Communication issued in International Patent Application No. PCT/JP2011/064545, mailed on Sep. 6, 2011.

Berkhout et al., "Acoustic control by wave field synthesis", Delft University of Technology, Laboratory of Seismics and Acoustics, Journal of the Acoustic Society of America, May 1993, pp. 2764-2778.

* cited by examiner

*Primary Examiner* — Akelaw Teshale

(74) *Attorney, Agent, or Firm* — Keating & Bennett, LLP

(57) ABSTRACT

Positive and negative two terminals of each of a plurality of main speakers constituting an array speaker are connected to each of amplifiers. Then, the main speakers are bridge-driven. Sub-speakers interpolating the main speakers are arranged respectively between the main speakers. Then, the positive and negative terminals of each of the sub-speakers are connected respectively to the terminals of the same polarities of the adjacent two of the main speakers. One sub-speaker receives an average value of the signals provided to the adjacent two main speakers, so that the one sub-speaker interpolates the wavefronts emitted from the adjacent two main speakers.

7 Claims, 11 Drawing Sheets

ACOUSTIC SYSTEM

This application is the national phase under 35 U.S.C. §371 of PCT International Application No. PCT/JP2011/064545 which has an International filing date of Jun. 24, 2011 and designated the United States of America.

FIELD

The present invention relates to an acoustic system.

BACKGROUND

A person recognizes an acoustic space on the basis of a loudness difference and a time difference in the sound inputted to two ears. A method of expressing an acoustic space by using this fact and employing left and right two speakers, that is, stereo recording, is generally used. In this acoustic system, a method called panning is also used that a mutual difference is imparted to the sound pressures of the sound emitted from the left and the right speakers, so as to cause a person to feel as if the sound were generated at a position between the speakers. Another method is also used that a time difference in the sound reaching microphones arranged at intervals is used so that a similar effect is achieved.

Nevertheless, the sound emitted from the left and the right speakers attenuates depending on the distance and a difference arises in the propagation time of the sound from the speakers. This results in a sound pressure difference and a time difference in the sound from the left and the right speakers depending on the position of the listener. Thus, the anticipated panning effect is achieved only on the center line located at equal distances from the two speakers arranged left and right. That is, a listener who listens the sound at any other position feels as the sound is emitted from the speaker located closer to the listener.

As a method for resolving the problem, for example, A. J. Berkhout, D. de Vries, and P. Vogel, "Acoustic control by wave field synthesis" (The Netherlands), 93(5)-th Print, Journal of the Acoustical Society of America (J. Acoust. Soc.), May 1993, pp. 2764-2778 describes an acoustic system employing a WFS (Wave Field Synthesis) technique and synthesizing a wavefront of sound by using an array speaker. In the WFS technique, an array speaker is employed that is constructed from a plurality of speakers arranged in one row. Then, the sound waves emitted from the respective speakers are superposed with each other so that a wavefront of the sound is synthesized such that a person should feel as if a sound source were located at the center point of the wavefront of the sound. The WFS technique reproduces the wavefront itself of the sound and hence, in a larger region, causes a person to feel as if the sound source were located at an anticipated position. Here, the center point of the wavefront of the sound generated by the array speaker is referred to as a virtual sound source.

In the plurality of speakers constituting the array speaker, a smaller value for the mutual arrangement intervals permits more satisfactory reproducibility of the wavefront of sound at higher frequencies. On the other hand, a larger value for the arrangement width of the array speaker expands the size of a space where the wavefront of sound is satisfactorily reproduced. Physically, the diameter of each speaker contained in the array speaker is smaller than or equal to each arrangement interval of the speakers. Thus, in order that an acoustic system satisfactorily reproducing the wavefront of sound at high frequencies should be realized, the diameter of each speaker need be reduced. On the other hand, the diameter of each speaker is restricted also by installation requirements in many cases. In particular, in a case that a speaker is to be incorporated into a television set, in order that the presence of the speaker should not extremely be apparent, an approach is often taken that the height or the width of the speaker is reduced and so is the area and that a speaker having a small diameter corresponding to the shorter side is employed. In another reason, for the purpose of cost reduction in the entire acoustic system including a signal processing part, in some cases, a large value is adopted for the arrangement intervals of speakers and, at the same time, speakers having relatively small diameters are selected.

Nevertheless, in a speaker having a small diameter, since its diaphragm area is small, the sound pressure obtainable with a finite diaphragm amplitude is limited. Thus, in such a speaker having a small diameter, problems on the acoustic characteristics arise, for example, that a high sound pressure is not generally achieved and that the reproduction frequency band is insufficient on the low pitch side. Further, as a result of the structure, the size of the diaphragm amplitude itself is smaller than that of a speaker having a large diameter. Although enlargement of the diaphragm area is effective for obtaining a higher sound pressure, in a case that any restriction prevents adoption of a speaker having a large diameter, a technique is employed that for the purpose of obtaining a sufficient sound pressure, a plurality of speakers are connected in parallel or in series and then the plurality of speakers are driven with the same signal so that the diaphragm area is equivalently increased. Nevertheless, when a plurality of speakers are driven with the same signal, the emitted waves from the speakers interfere with each other and hence high directivity is caused in the sound waves. In an array speaker, the sound waves emitted from the respective speakers are superposed with each other so that a wavefront of the sound is synthesized. Thus, it is appropriate that the emission characteristics of each speaker is of non-directivity. Accordingly, driving a plurality of speakers with the same signal causes disturbance in the wavefronts of the sound and hence prevents achievement of the original performance of the array speaker. On the other hand, in order that the reproduction frequency band on the low pitch side should be expanded, enlargement of the diameter of the speaker is effective. Nevertheless, this approach causes similar problems and hence is not practical in many cases.

Further, in the case of an array speaker, when the intervals of a plurality of speakers constituting the array speaker are large, a problem arises that a listener close to the array speaker feels that a sound source is located at the position of a speaker near the listener. This is because the curvature of each wavefront emitted actually is smaller than that of the wavefront to be reproduced. In the WFS, wavefronts generated by the respective speakers are superposed with each other so that a wavefront is reproduced. Then, when the speaker density is insufficient for wavefront superposition, a smooth wavefront is not reproduced. In other words, in order that a smooth wavefront should be reproduced, the intervals of the speakers need be reduced so that a sufficient speaker density need be ensured. An employable approach for achieving this is that speakers are added for complementing the wavefronts emitted from the original speakers.

In conclusion, in order that an acoustic system employing an array speaker should reproduce sound at higher frequencies in a larger region, speakers having small diameters need be arranged at intervals as narrow as possible and in a number as large as possible and then these speakers need be controlled.

However, on the other hand, in order that a high sound pressure should be obtained in lower frequency sound, speakers having diameters as large as possible need be incorporated in a number as large as possible into the acoustic system.

As a method for resolving such problems caused by the relation between the size of the diameter of the speaker and the width of the frequency band, for example, Japanese Patent Application Laid-Open No. 2006-67301 describes an apparatus in which an array speaker is constructed by combining a plurality of speakers having mutually different diameters for each frequency band so that the sound frequency band is broadened.

SUMMARY

Nevertheless, in the apparatus described in Japanese Patent Application Laid-Open No. 2006-67301, signal processing devices corresponding to the plurality of speakers constituting the array speaker and amplifiers for driving the speakers need be provided in a number equal to the number of speakers. This causes an increase in the amount of hardware of signal processing devices and amplifiers and hence causes an increase in the construction cost of the acoustic system.

Further, when an acoustic system is to be constructed, in a case that speakers having small diameters are used by any reason, the arrangement intervals of these speakers may be reduced and then the diaphragm area may be equivalently enlarged so that the output sound pressure of the speakers may be increased. Nevertheless, in order that the diaphragm area should be enlarged, the number of speakers having small diameters need be increased. This causes an increase in the number of signal processing devices and amplifiers and hence causes an increase in the amount of hardware of the acoustic system. As a result, the construction cost increases in the acoustic system.

Thus, the present invention has been devised in view of such situations. Its object is to provide an acoustic system in which even when the number of speakers is increased for the purpose of interpolating the wavefronts emitted from the speakers, an associated increase is not caused in the amount of hardware of signal processing devices and amplifiers.

The acoustic system of the present invention is characterized by an acoustic system employing an array speaker including at least three speakers, comprising: two input terminals receiving signals respectively corresponding to two second speakers adjacent to one first speaker; and a drive unit driving the two second speakers on the basis of the signals inputted through the two input terminals, wherein positive terminals provided respectively in the two second speakers are connected respectively to two positive terminals of the drive unit corresponding to the two second speakers and negative terminals provided respectively in the two second speakers are connected respectively to two negative terminals of the drive unit corresponding to the two second speakers, and wherein a positive terminal and a negative terminal provided in the one first speaker are connected respectively to the positive terminal provided in any one of the two second speakers and to the negative terminal provided in the other second speaker.

In the present invention, even when in a group of speakers whose each one line is connected to one line of signal processing systems and amplifiers, another group of speakers is provided at positions interpolating the lines and then the groups of speakers in a number greater than the number of input signals are driven, without the necessity of an increase in the amount of hardware of the signal processing systems and the amplifiers, the wavefronts of the sound emitted from the group of speakers whose each one line is connected are interpolated by applying an average value within the line to the another group of speakers.

The acoustic system of the present invention is characterized by an acoustic system employing an array speaker including at least three speakers, comprising: two input terminals receiving signals respectively corresponding to two second speakers adjacent to one first speaker; a drive unit driving the two second speakers on the basis of the signals inputted through the two input terminals; and a circuit inserted between any one of the terminals provided in any one of the two second speakers and the input terminal corresponding to the terminal and inverting a phase of any one of the signals inputted to the two input terminals, wherein a positive terminal and a negative terminal provided in the one first speaker are connected respectively to the positive terminal provided in any one of the two second speakers and to the negative terminal provided in the other second speaker.

In the present invention, even when in a group of speakers whose each one line is connected to one line of signal processing systems and amplifiers, another group of speakers is provided at positions interpolating the lines and then the groups of speakers in a number greater than the number of input signals are driven, without the necessity of an increase in the amount of hardware of the signal processing systems and the amplifiers, the wavefronts of the sound emitted from the group of speakers whose each one line is connected are interpolated by applying an added value within the line to the another group of speakers.

The acoustic system of the present invention is characterized in that the one first speaker is located at equal distances from the two second speakers.

In the present invention, the one speaker of another line is arranged at equal distances from the two speakers of a group contained in one line, so that an error in the wavefront emitted from the speaker of the another line is reduced.

The acoustic system of the present invention is characterized in that the one first speaker has an impedance equal to 4-fold of an impedance of each of the two second speakers.

In the present invention, the impedance of one speaker is set equal to 4-fold of the impedance of each of two speakers adjacent to the one speaker. By virtue of this, when the same signal is inputted to each input terminal, the one speaker and the two speakers adjacent to the one speaker which are connected to each other receive electricity of the same amount.

The acoustic system of the present invention is characterized by an acoustic system employing an array speaker including at least three speakers, comprising: a plurality of second speakers arranged in one row; one or a plurality of first speakers provided in a number smaller than the number of the plurality of second speakers and arranged in a row different from the plurality of second speakers; two input terminals receiving signals respectively corresponding to two second speakers adjacent to one first speaker; and a drive unit driving the two second speakers on the basis of the signals inputted through the two input terminals, wherein positive terminals provided respectively in the two second speakers are connected respectively to two positive terminals of the drive unit corresponding to the two second speakers and negative terminals provided respectively in the two second speakers are connected respectively to two negative terminals of the drive unit corresponding to the two second speakers, and wherein a positive terminal and a negative terminal provided in the one first speaker are connected respectively to the positive terminal provided in any one of the two second speakers and to the negative terminal provided in the other second speaker.

In the present invention, even when in a group of aligned-in-one-row speakers whose each one line is connected to one line of signal processing systems and amplifiers, another group of speakers is provided at positions interpolating the lines and aligned in a row different from the group of speakers of the one line and then the groups of speakers in a number greater than the number of input signals without the necessity of an increase in the amount of hardware of the signal processing systems and the amplifiers, the wavefronts of the sound emitted from the group of speakers of the one line are interpolated by applying an average value within the line to the another group of speakers.

The acoustic system of the present invention is characterized by an acoustic system employing an array speaker including at least three speakers, comprising: a plurality of second speakers arranged in one row; one or a plurality of first speakers provided in a number smaller than the number of the plurality of second speakers and arranged in a row different from the plurality of second speakers; two input terminals receiving signals respectively corresponding to two second speakers adjacent to one first speaker; a drive unit driving the two second speakers on the basis of the signals inputted through the two input terminals; and a circuit inserted between any one of the terminals provided in any one of the two second speakers and the input terminal corresponding to the terminal and inverting a phase of any one of the signals inputted to the two input terminals, wherein a positive terminal and a negative terminal provided in the one first speaker are connected respectively to the positive terminal provided in any one of the two second speakers and to the negative terminal provided in the other second speaker.

In the present invention, even when in a group of aligned-in-one-row speakers whose each one line is connected to one line of signal processing systems and amplifiers, another group of speakers is provided at positions interpolating the lines and aligned in a row different from the group of speakers of the one line and then the groups of speakers in a number greater than the number of input signals without the necessity of an increase in the amount of hardware of the signal processing systems and the amplifiers, the wavefronts of the sound emitted from the group of speakers of the one line are interpolated by applying an average value within the line to the group of speakers in the above-mentioned different row.

The acoustic system of the present invention is characterized in that the one first speaker is located at equal distances from the two second speakers.

In the present invention, in a group of speakers arranged in two rows, one speaker of another line in another row is arranged at equal distances from two speakers of a group contained in one line in one row, so that an error in the wavefront emitted from the speaker of the another line is reduced.

According to the present invention, for example, in a case of 15 speakers, an acoustic system is realized by employing signal processing systems for eight channels and amplifiers for eight channels. Thus, an effect is obtained that speakers interpolating the waveforms are allowed to be added without the necessity of an increase in the amount of hardware of the signal processing systems and the amplifiers.

The above and further objects and features will more fully be apparent from the following detailed description with accompanying drawings.

DETAILED DESCRIPTION

Embodiments are described below in detail with reference to the drawings.

Embodiment 1

Figure 1:
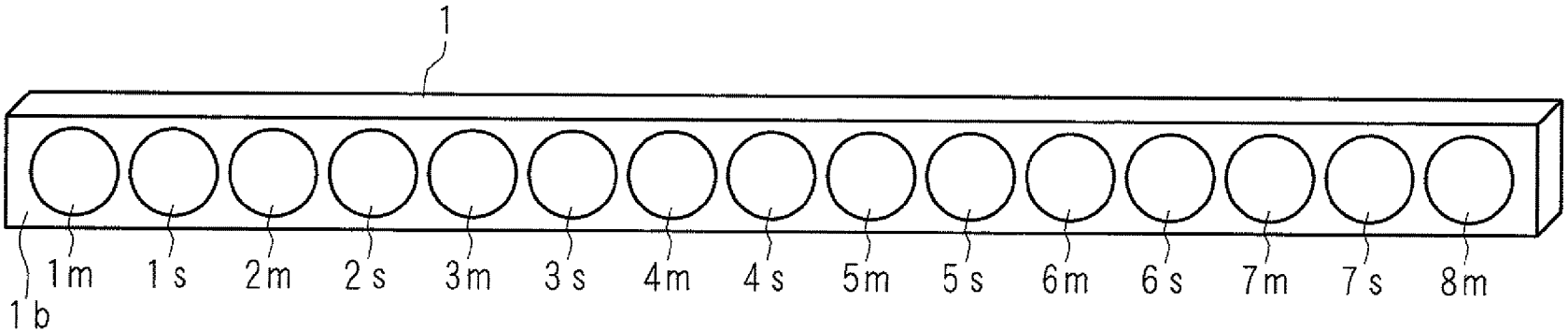
FIG. 1 is an explanation diagram illustrating an example of external appearance of an array speaker.

FIG. 1 is an explanation diagram illustrating an example of external appearance of an array speaker.

In FIG. 1, an array speaker 1 includes main speakers (second speakers) 1*m* to 8*m* and sub-speakers (first speakers) 1*s* to 7*s*. The main speakers 1*m* to 8*m* and the sub-speakers 2*s* to 7*s* are respectively arranged alternately on a baffle board 1*b* in the front face of the array speaker 1. That is, in the array speaker 1, when viewed from the front face of the casing, the speakers 1*m*, 1*s*, 2*m*, 2*s*, 3*m*, 3*s*, 4*m*, 4*s*, 5*m*, 5*s*, 6*m*, 6*s*, 7*m*, 7*s*, and 8*m* are arranged in this order starting at the left.

The main speakers 1*m* to 8*m* are driven with input signals and the sub-speakers 1*s* to 7*s* are driven with interpolation signals. Details of the input signals and the interpolation signals are described later.

Figure 2:
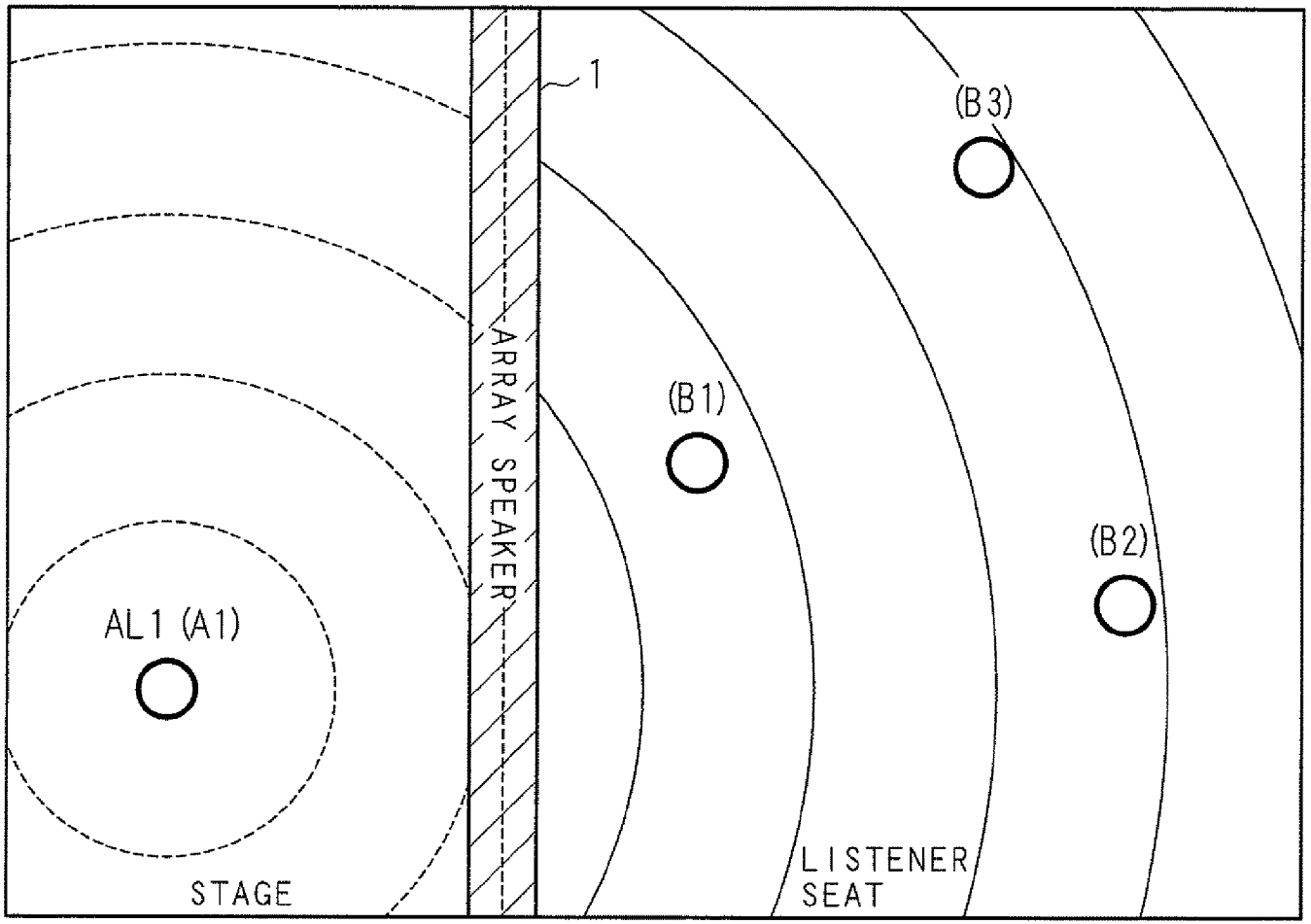
FIG. 2 is an explanation diagram schematically illustrating a virtual sound source position and the position of an array speaker.

FIG. 2 is an explanation diagram schematically illustrating a virtual sound source position and the position of the array speaker.

In FIG. 2, a stage and listener seats are provided on the respective sides of the array speaker 1. A virtual sound source A1 is arranged on the stage and listeners B1 to B3 are located on the listener seats. AL1 indicates the position of the virtual sound source A1.

According to the WFS, the speakers 1*m* to 8*m* and 1*s* to 7*s* constituting the array speaker 1 reproduces the wavefront of the sound spreading from the virtual sound source A1, so that the listeners B1 to B3 feel as if a sound source were located at the position of the virtual sound source A1.

Figure 3:
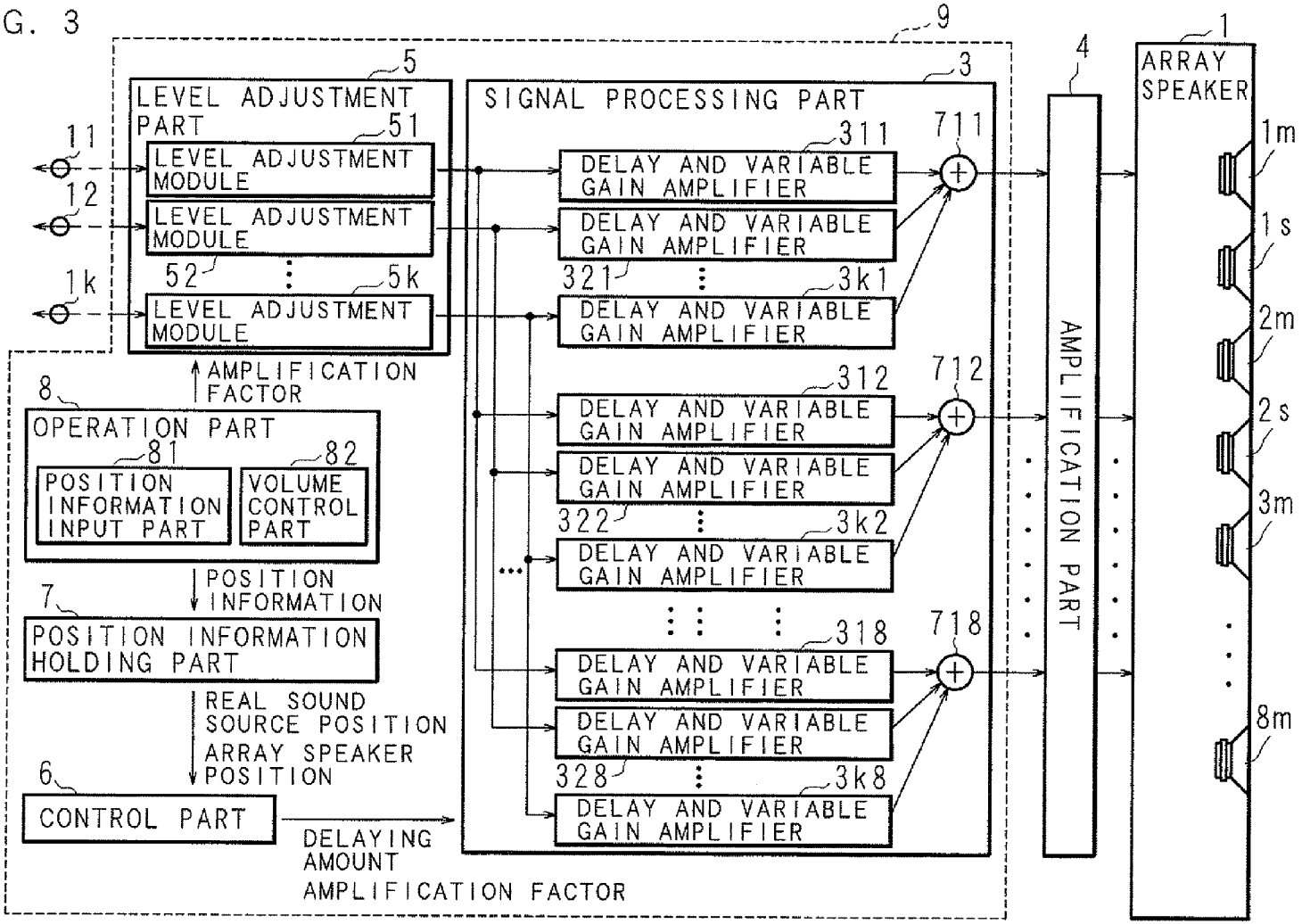
FIG. 3 is a block diagram illustrating an example of overall configuration of an acoustic system.

FIG. 3 is a block diagram illustrating an example of overall configuration of the acoustic system.

In an overview, the acoustic system has k microphones 11 to 1*k*, a wavefront synthesis signal processing part 9, an amplification part 4, and the array speaker 1. The wavefront synthesis signal processing part 9 has a level adjustment part 5, a control part 6, a position information holding part 7, an operation part 8, and a signal processing part 3. Further, the array speaker 1 is constructed from the 15 speakers 1*m* to 8*m* and 1*s* to 7*s*. Here, k is an integer greater than or equal to unity.

The level adjustment part 5 has k pieces of level adjustment modules 51 to 5*k*.

The signal processing part 3 has k×8 pieces of delay and variable gain amplifiers 311 to 3*k*8 and eight adders 711 to 718.

After amplifying a sound signal inputted through the microphone 11, the level adjustment module 51 provides as a signal of a first line the obtained signal to the eight delay and variable gain amplifiers 311 to 318. After amplifying a sound signal inputted through the microphone 12, the level adjustment module 52 provides as a signal of a second line the obtained signal to the eight delay and variable gain amplifiers 321 to 328. After amplifying a sound signal inputted through the microphone 1*k*, the level adjustment module 5*k* provides as a signal of a k-th line the obtained signal to the eight delay and variable gain amplifiers 3*k*1 to 3*k*8.

The delay and variable gain amplifiers 311 to 318 cause delays in the signals of the first line and then perform variable gain amplification. Further, the delay and variable gain amplifiers 321 to 328 cause delays in the signals of the second line and then perform variable gain amplification. Further, the delay and variable gain amplifiers 3*k*1 to 3*k*8 cause delays in the signals of the k-th line and then perform variable gain amplification. As such, the delay and variable gain amplifiers 311 to 318, 321 to 328, . . . , 3*k*1 to 3*k*8 respectively cause delay and then perform variable gain amplification on the signals of the first line to the k-th line. At that time, the delaying amounts and the amplification factors are calculated by the control part 6 described later. The delay and variable gain amplifiers 311 to 318, 321 to 328, . . . , 3*k*1 to 3*k*8 cause delay and perform variable gain amplification on the signals of the first line to the k-th line respectively on the basis of the delaying amounts and the amplification factors calculated by the control part 6.

As such, the signals of the first line to the k-th line corresponding to the microphones 11 to 1*k* are respectively delayed and variable-gain-amplified by the delay and variable gain amplifiers 311 to 318, 321 to 328, . . . , 3*k*1 to 3*k*8. The signals obtained by delay and variable gain amplification performed by the delay and variable gain amplifiers 311 to 318, 321 to 328, . . . , 3*k*1 to 3*k*8 are added together respectively by the adders 711 to 718 and then separated into signals of the first to the eighth channels. Then, the signals of the first to the eighth channels obtained by the separation are provided to the amplification part 4.

The adders 711 to 718 are described below in further detail.

The adder 711 adds together the output signals of the delay and variable gain amplifiers 311 to 3*k*1 and then provides as a signal of the first channel the obtained signal to the amplification part 4. The adder 712 adds together the output signals of the delay and variable gain amplifiers 312 to 3*k*2 and then provides as a signal of the second channel the obtained signal to the amplification part 4. The adder 718 adds together the output signals of the delay and variable gain amplifiers 318 to 3*k*8 and then provides as a signal of the eighth channel the obtained signal to the amplification part 4. As such, the signal processing part 3 provides the signals of the first to the eighth channels to the amplification part 4.

The amplification part 4 has an array speaker driving part (a drive unit) described later. The array speaker driving part amplifies the input signals of the first to the eighth channels and then provides the amplified signals to the corresponding main speakers 1*m* to 8*m* and sub-speakers 1*s* to 7*s*. Then, the main speakers 1*m* to 8*m* and the sub-speakers 1*s* to 7*s* emit wavefronts of the sound on the basis of the signals provided from the array speaker driving part.

The operation part 8 is an operation device used when an operator is to operate the acoustic system, and has a position information input part 81 and a volume control part 82. The position information input part 81 receives position information consisting of a virtual sound source position and the positions of the speakers 1*m* to 8*m* constituting the array speaker 1, which is inputted by the operator. The position information holding part 7 provides to the control part 6 the position information received from the operation part 8. In response to the operation performed by the operator, the volume control part 82 provides the amplification factors individually to the level adjustment modules 51 to 5*k*, so that the respective sound signals are spread to the listener seats at appropriate sound volume levels and sound volume balances.

The control part 6 calculates delaying amounts and amplification factors corresponding to the distances, and then sets up the delaying amounts td and the amplification factors G obtained by the calculation respectively into the delay and variable gain amplifiers 311 to 318, 321 to 328, . . . , 3*k*1 to 3*k*8 in the signal processing part 3 respectively provided in correspondence to the speakers 1*m* to 8*m* constituting the array speaker 1.

Each delaying amount td to be set up in each delay unit and each amplification factor G to be set up in each variable gain amplifier are calculated in accordance with the following formulas. Here, the distance from the virtual sound source A1 to each of the speakers 1*m* to 8*m* is denoted by d.

Delaying amount $td=d/c$ where $c$ is the speed of sound

Amplification factor $G=dr$ where $r$ is a space attenuation constant $(0>r>-2)$ As described above, for example, on the basis of the delaying amounts and the amplification factors, the signal processing part 3 processes the received sound signal 11 inputted in correspondence to the virtual sound source A1 and then provides to the amplification part 4 the signals obtained by the processing.

Figure 4:
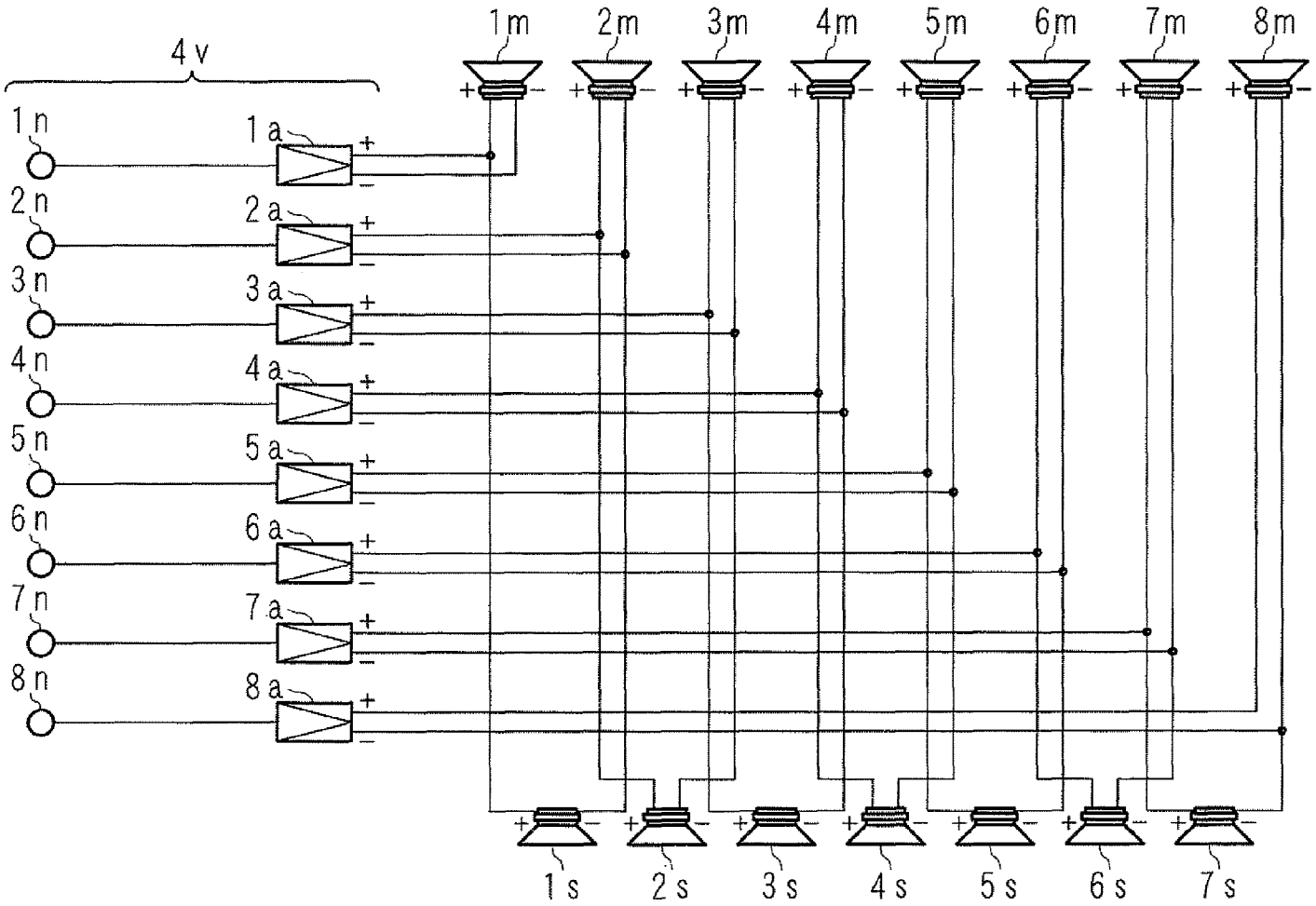
FIG. 4 is a block diagram illustrating an example of overall configuration of an array speaker and an array speaker driving part according to Embodiment 1.

FIG. 4 is a block diagram illustrating an example of overall configuration of the array speaker and the array speaker driving part according to Embodiment 1.

The array speaker driving part 4*v* is a unit contained in the amplification part 4 illustrated in FIG. 3 and has the function of supplying electricity to the speakers 1*m* to 8*m* and 1*s* to 7*s*. The array speaker driving part 4*v* has eight input terminals 1*n* to 8*n* and eight amplifiers 1*a* to 8*a*. The input terminals 1*n* to 8*n* are connected respectively to the amplifiers 1*a* to 8*a*. Then, the amplifiers 1*a* to 8*a* are connected respectively to the corresponding main speakers 1*m* to 8*m* and sub-speakers 1*s* to 7*s*.

The connecting relation among the amplifiers 1*a* to 8*a*, the main speakers 1*m* to 8*m*, and the sub-speakers 1*s* to 7*s* is described below in further detail.

The positive terminals (+) of the amplifiers 1*a* to 7*a* are connected respectively to the positive terminals (+) of the main speakers 1*m* to 7*m* and the sub-speakers 1*s* to 7*s*. The positive terminal (+) of the amplifier 8*a* is connected to the positive terminal (+) of the main speaker 8*m*. On the other hand, the negative terminal (−) of the amplifier 1*a* is connected to the negative terminal (−) of the main speaker 1*m*. The negative terminals (−) of the amplifiers 2*a* to 8*a* are connected respectively to the negative terminals (−) of the main speakers 2*m* to 8*m* and the sub-speakers 1*s* to 7*s*.

The input terminals 1*n* to 8*n* respectively receive the eight signals obtained by the processing performed by the signal processing part 3 illustrated in FIG. 3 and then transmit the eight input signals to the corresponding amplifiers 1*a* to 8*a*. The amplifiers 1*a* to 8*a* amplify the input signals received through the input terminals 1*n* to 8*n* and then transmit the obtained signals to the main speakers 1*m* to 8*m* and the sub-speakers 1*s* to 7*s*. Here, the amplifiers 1*a* to 8*a* perform balance amplification on the input signals received through the input terminals 1*n* to 8*n*. That is, the amplifiers 1*a* to 8*a* transmit, to the main speakers 1*m* to 8*m* and the sub-speakers 1*s* to 7*s*, signals obtained by amplification in the same phase as the input signals relative to a reference voltage and signals obtained by amplification in the reverse phase as the input signals relative to the reference voltage all of which have the same amplitude.

The signals obtained by balance amplification performed by the amplifiers 1*a* to 8*a* are provided to the positive terminals (+) and the negative terminals (−) of the main speakers 1*m* to 8*m*. For example, the positive terminals (+) and the negative terminals (−) of the main speakers 1*m* to 8*m* receive two signals that are balance-driven, that is, vary in mutually opposite phases at the same amplitude relative to the reference voltage.

On the other hand, the positive terminals (+) and the negative terminals (−) of the sub-speakers 1*s* to 7*s* are connected respectively to the terminals of the same polarities of the adjacent ones of the amplifiers 1*a* to 8*a*. Then, the positive terminals (+) and the negative terminals (−) of the sub-speakers 1*s* to 7*s* receive the signals transmitted from the amplifiers 1*a* to 8*a* in correspondence to the mutually different inputs. For example, the positive terminal (+) of the sub-speaker 1*s* connected to the positive terminal (+) of the main speaker 1*m*, and the negative terminal (−) of the sub-speaker 1*s* is connected to the negative terminal (−) of the main speaker 2*m*. Thus, the positive terminal (+) of the sub-speaker 1*s* receives the signal from the positive terminal (+) of the amplifier 1*a* and the negative terminal (−) of the sub-speaker 1*s* receives the signal from the negative terminal (−) of the amplifier 2*a* adjacent to the amplifier 1*a*.

The main speakers 1*m* and 2*m* are balance-driven. Thus, the positive terminal (+) of the main speaker 1*m* receives a voltage equal to half the driving voltage applied to the main speaker 1*m* relative to the reference voltage. Similarly, the negative terminal (−) of the main speaker 2*m* receives a voltage equal to half the driving voltage applied to the main speaker 2*m* relative to the reference voltage, in the reverse phase. Thus, the sub-speaker 1*s* connected to the positive terminal (+) of the main speaker 1*m* and to the negative terminal (−) of the main speaker 2*m* receives a voltage equal to half the driving voltage of the main speaker 1*m* and a voltage equal to half the driving voltage of the main speaker 2*m*. This situation is equivalent to that the sub-speaker 1*s* receives the average value of the driving voltages of the main speakers 1*m* and 2*m*.

As described above, the array speaker driving part 4*v* amplifies, by using the amplifiers 1*a* to 8*a*, the input signals inputted through the input terminals 1*n* to 8*n* and then provides the amplified signals respectively to the corresponding main speakers 1*m* to 8*m* and sub-speakers 1*s* to 7*s*. Then, the speakers 1*m* to 8*m* and 1*s* to 7*s* emit wavefronts of the sound on the basis of the signals transmitted from the amplifiers 1*a* to 8*a*.

Here, the array speaker 1 has the function of synthesizing a wavefront by superposing the sound waves emitted from the plurality of main speakers 1*m* to 8*m* and sub-speakers 1*s* to 7*s* constituting the array speaker 1. Thus, the signals provided to the main speakers 1*m* to 8*m* and the sub-speakers 1*s* to 7*s* constituting the array speaker 1 have strong correlation with each other.

For example, in the WFS, delays and space attenuations caused at the time of sound wave propagation from the virtual sound source position to the positions of the main speakers 1*m* to 8*m* and the sub-speakers 1*s* to 7*s* constituting the array speaker 1 are reproduced by the signal processing part 3 illustrated in FIG. 3, that is, by the delay and variable gain amplifiers 311 to 318, 321 to 328, . . . , 3*k*1 to 3*k*8, so that a wavefront whose center is located at the virtual sound source position is emitted from the array speaker 1.

As described above, in the input signals provided to the amplifiers 1*a* to 8*a* in the array speaker driving part 4*v*, the time differences are determined depending on the relative differences of the distances from the virtual sound source to the main speakers 1*m* to 8*m* constituting the array speaker 1 and the amplitudes are determined depending on the distances from the virtual sound source to the main speakers 1*m* to 8*m*. Thus, when each interval of the main speakers 1*m* to 8*m* constituting the array speaker 1 is shorter than the wavelength or alternatively when the distance from the array speaker 1 to the virtual sound source is longer, the phase differences between the input signals transmitted to the amplifiers 1*a* to 8*a* become small. On the other hand, when the width of the array speaker 1 is shorter than the wavelength or alternatively when the angle formed by the array speaker 1 and the virtual sound source is close to the right angle, the maximum value of the phase differences of the input signals transmitted to the amplifiers 1*a* to 8*a* becomes small.

Further, when the virtual sound source position is located distant from the positions of the speakers 1*m* to 8*m* and 1*s* to 7*s* and hence the curvature of the wavefront is large near the speakers 1*m* to 8*m* and 1*s* to 7*s*, the error becomes small between each signal generated by interpolation, that is, each average value, and the true value of each of the object signals corresponding to the positions of the sub-speakers 1*s* to 7*s*.

Figure 5:
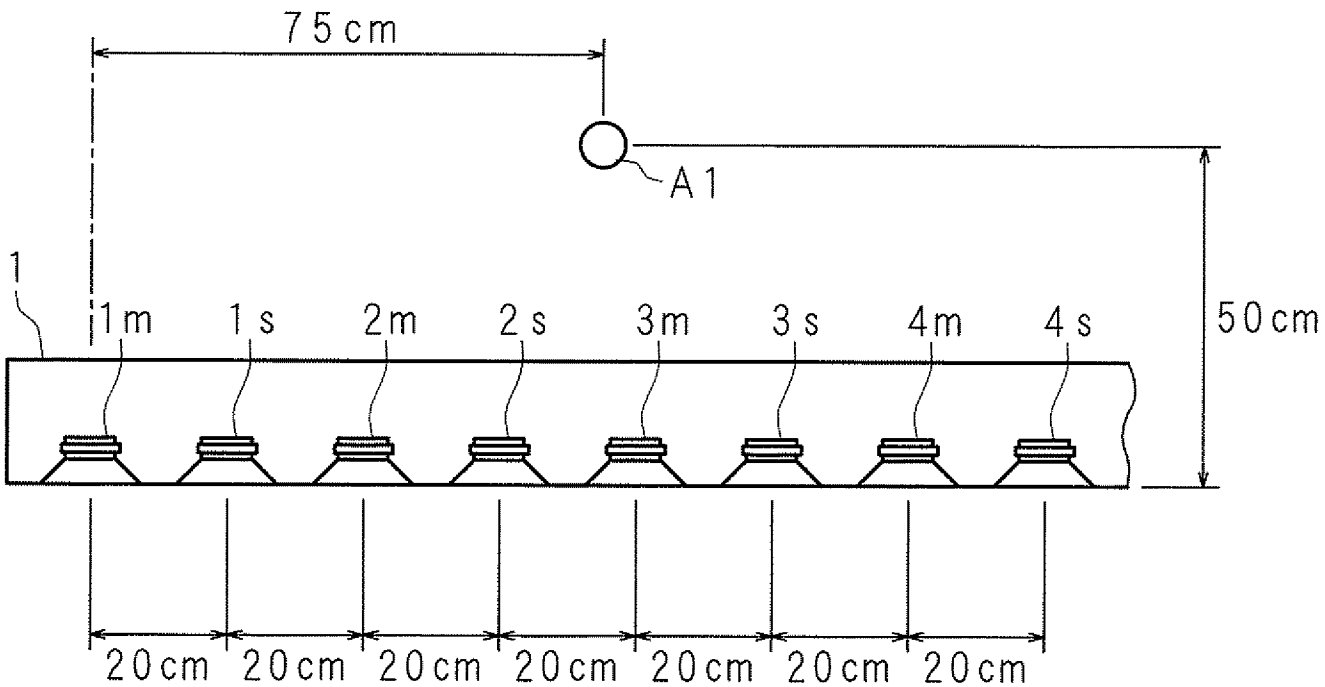
FIG. 5 is an explanation diagram illustrating an example of positional relation between an array speaker and a virtual sound source.
Figure 6:
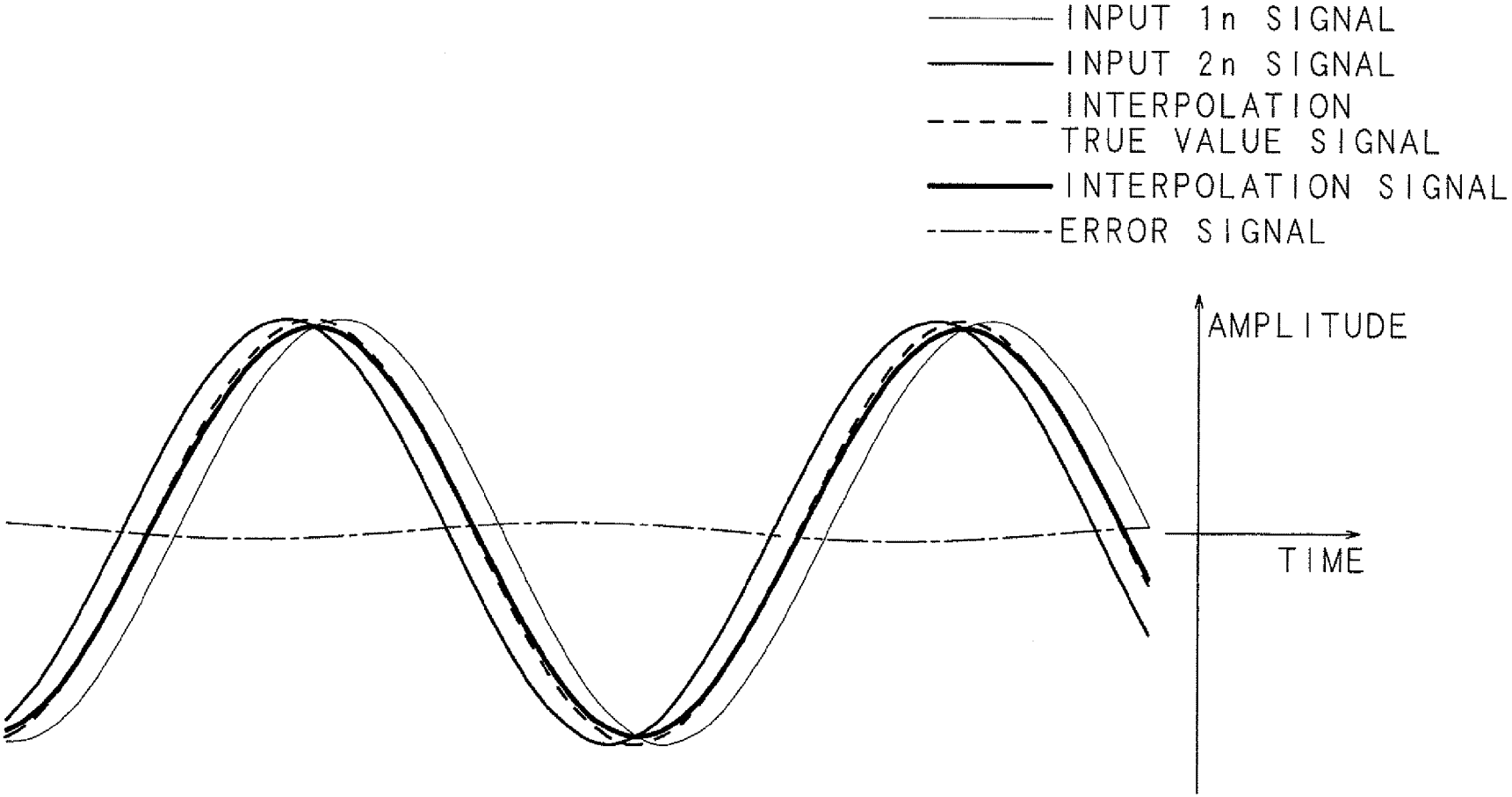
FIG. 6 is an explanation diagram illustrating various kinds of waveforms in a case that a 100-Hz sine wave is assumed to be emitted from a virtual sound source.

FIG. 5 is an explanation diagram illustrating an example of the positional relation between the array speaker and the virtual sound source. FIG. 6 is an explanation diagram illustrating various kinds of waveforms in a case that a 100-Hz sine wave is assumed to be emitted from the virtual sound source.

In FIG. 5, in the array speaker 1, the main speakers 1*m* to 4*m* and the sub-speakers 1*s* to 4*s* are alternately arranged at intervals of 20 cm. The virtual sound source A1 is located at a position of 50-cm distance from the speaker front face of the array speaker 1 toward the speaker rear face side and of 75-cm distance in a direction from the main speaker 1*m* toward the sub-speaker 4*s*.

Further, FIG. 6 illustrates the waveforms of the signals (the 1*n* signal and the 2*n* signal) provided to the main speakers 1*m* and 2*m* and the sub-speaker 1*s*, the interpolation true value signal necessary for reproducing the wavefront corresponding to the sub-speaker 1*s* position, and the error signal between the interpolation signal inputted to the sub-speaker 1*s* and interpolation true value signal, in a case that a 100-Hz sine wave is emitted from the virtual sound source A1 in the array speaker 1 having the positional relation illustrated in FIG. 5. In FIG. 6, the horizontal axis direction of the waveform indicates time and the vertical axis direction indicates the wave amplitude.

As described above, for example, the sub-speaker 1*s* receives the average value of the driving voltages of the main speakers 1*m* and 2*m*. Then, the maximum difference in the distances of the respective main speakers from the virtual sound source position is 40 cm and hence is shorter than the wavelength of the 100-Hz sound wave which is approximately 3.4 m (at ordinary temperatures). Thus, a large phase difference is not produced. Further, as illustrated in FIG. 6, a large error does not arise between the interpolation signal corresponding to the sub-speaker 1*s* position and the interpolation true value signal.

As such, in the eight main speakers 1*m* to 8*m*, the seven sub-speakers 1*s* to 7*s* at maximum are added. Then, the average value of the driving voltages applied to each adjacent two (e.g., the main speakers 1*m* and 2*m*) of the main speakers 1*m* to 8*m* is applied to each of the sub-speakers 1*s* to 7*s*. By virtue of this, the sub-speakers 1*s* to 7*s* are allowed to be arranged in such a manner that the wavefronts generated by the main speakers 1*m* to 8*m* are interpolated. The signals provided to the sub-speakers 1*s* to 7*s* are interpolation signals. Thus, the array speaker 1 constructed from the main speakers 1*m* to 8*m* and the sub-speakers 1*s* to 7*s* achieves synthesis of a wavefront closer to the desired wavefront in comparison with a case of parallel drive or series drive of the main speakers 1*m* to 8*m*.

Thus, in the main speakers 1*m* to 8*m* and the sub-speakers 1*s* to 7*s* of 15 lines, an acoustic system is realized by employing the signal processing part 3 for eight channels and the amplifiers 1*a* to 8*a* for eight channels. Accordingly, an effect is obtained that even when the number of speakers is increased, an increase is avoided in the amount of hardware of the signal processing part 3 and the amplification part 4.

Here, the sub-speakers 1*s* to 7*s* may be arranged anywhere as long as each sub-speaker is located adjacent to each two main speakers. However, when each sub-speaker is arranged at a position of the same distance from the two main speakers, no trouble occurs in the emitted wavefront regardless of the virtual sound source position. Further, when the main speakers 1*m* to 8*m* and the sub-speakers 1*s* to 7*s* are composed of speakers of the same type, an effect is obtained that the error is reduced between the wavefront from the virtual sound source position and the wavefront emitted from the sub-speaker.

Here, in the present embodiment, the seven sub-speakers 1*s* to 7*s* are connected to the signal processing part 3 and the amplifiers 1*a* to 8*a* for eight channels. However, not all of the seven sub-speakers need be connected.

Figure 7:
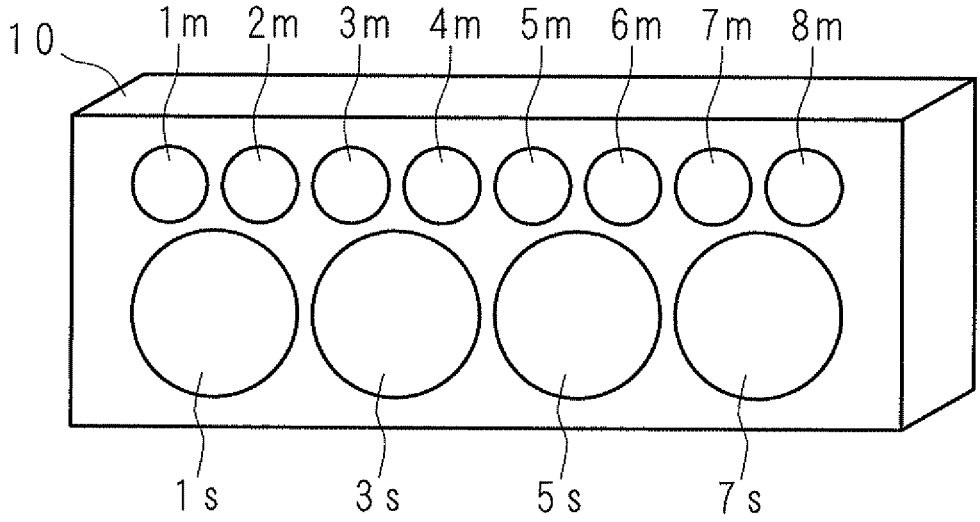
FIG. 7 is an explanation diagram illustrating an example of external appearance of another array speaker.

FIG. 7 is an explanation diagram illustrating an example of external appearance of another array speaker.

In an array speaker 10, eight main speakers 1*m* to 8*m* are arranged in one row. Then, four sub-speakers 1*s*, 3*s*, 5*s*, and 7*s* are arranged in a row different from the row of the main speakers 1*m* to 8*m*. That is, the eight main speakers 1*m* to 8*m* and the four sub-speakers 1*s*, 3*s*, 5*s*, and 7*s* are arranged in two rows. Here, when viewing the front face of the array speaker 10, the main speakers 1*m*, 2*m*, 3*m*, 4*m*, 5*m*, 6*m*, 7*m*, and 8*m* are arranged in this order. On the other hand, similarly, the sub-speakers 1*s*, 3*s*, 5*s*, and 7*s* are arranged in this order. Here, in the present example, the eight speakers 1*m* to 8*m* and the four sub-speakers 1*s*, 3*s*, 5*s*, and 7*s* have been employed. However, the number of employed sub-speakers may be an arbitrary value from 1 to 4.

Further, in the WFS, as described above, the time delays are set up in correspondence to the distances from the virtual sound source to the main speakers 1*m* to 8*m* and the sub-speakers 1*s* to 7*s*. Thus, the phase differences between the signals of the main speakers are determined from the angle between the virtual sound source position and the speaker array and from the speaker interval and the wavelength.

Figure 8:
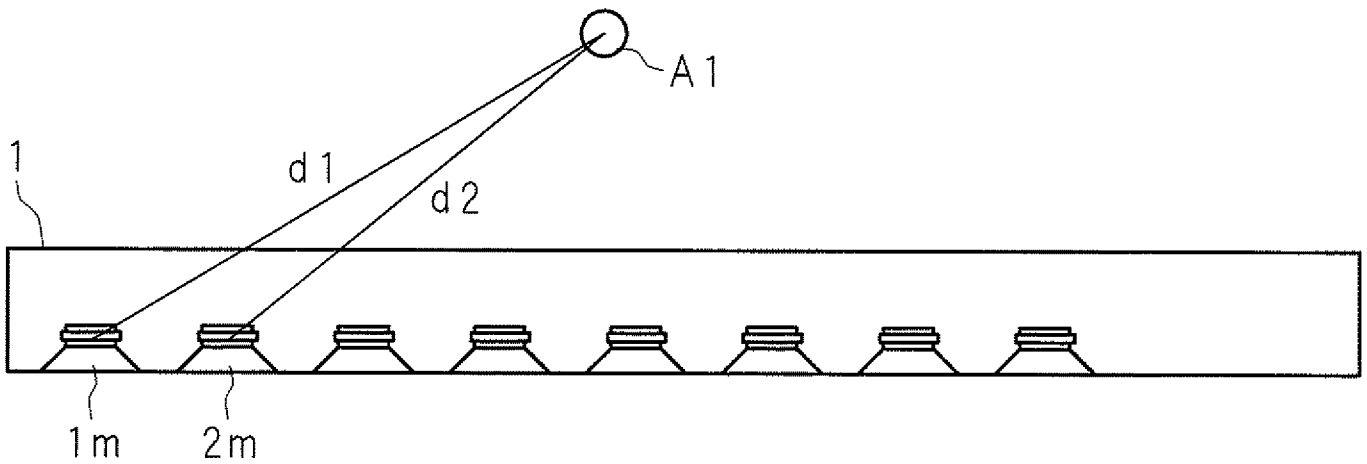
FIG. 8 is an explanation diagram illustrating an example of positional relation between an array speaker and a virtual sound source.

FIG. 8 is an explanation diagram illustrating an example of the positional relation between the array speaker and the virtual sound source.

Referring to FIG. 8, when the distance from the virtual sound source A1 to the main speaker 1*m* is denoted by d1 and the distance from the virtual sound source A1 to the speaker 2*m* is denoted by d2, the phase difference θ between the signals to be applied to the main speakers 1*m* and 2*m* is expressed by the following formula.

$$\theta=2\pi\times\Delta d/\lambda=2\times|d1-d2|/(c/f)$$

Here, the speed of sound is c and the frequency is f.

On the other hand, each of the sub-speakers 1*s* to 7*s* receives the average value of the driving voltages applied to each adjacent ones of the main speakers 1*m* to 8*m*. Thus, when the signals applied to the adjacent two main speakers are in the opposite phases, no signal is applied to the sub-speaker. Thus, the frequency upper limit fH of the signals where interpolation is achievable is as follows.

$$fH=c/(2\Delta d)=c/|2d1-2d2|$$

Thus, the condition that a wavefront traveling in parallel to the array speaker 1 is reproduced gives the lowest value for the upper limit of the frequency where the wavefront reproduction is achievable. When the speaker pitch is denoted by d and the speed of sound is denoted by c, the frequency fz at that time is expressed as follows.

$$fz=c/2d$$

Figure 9:
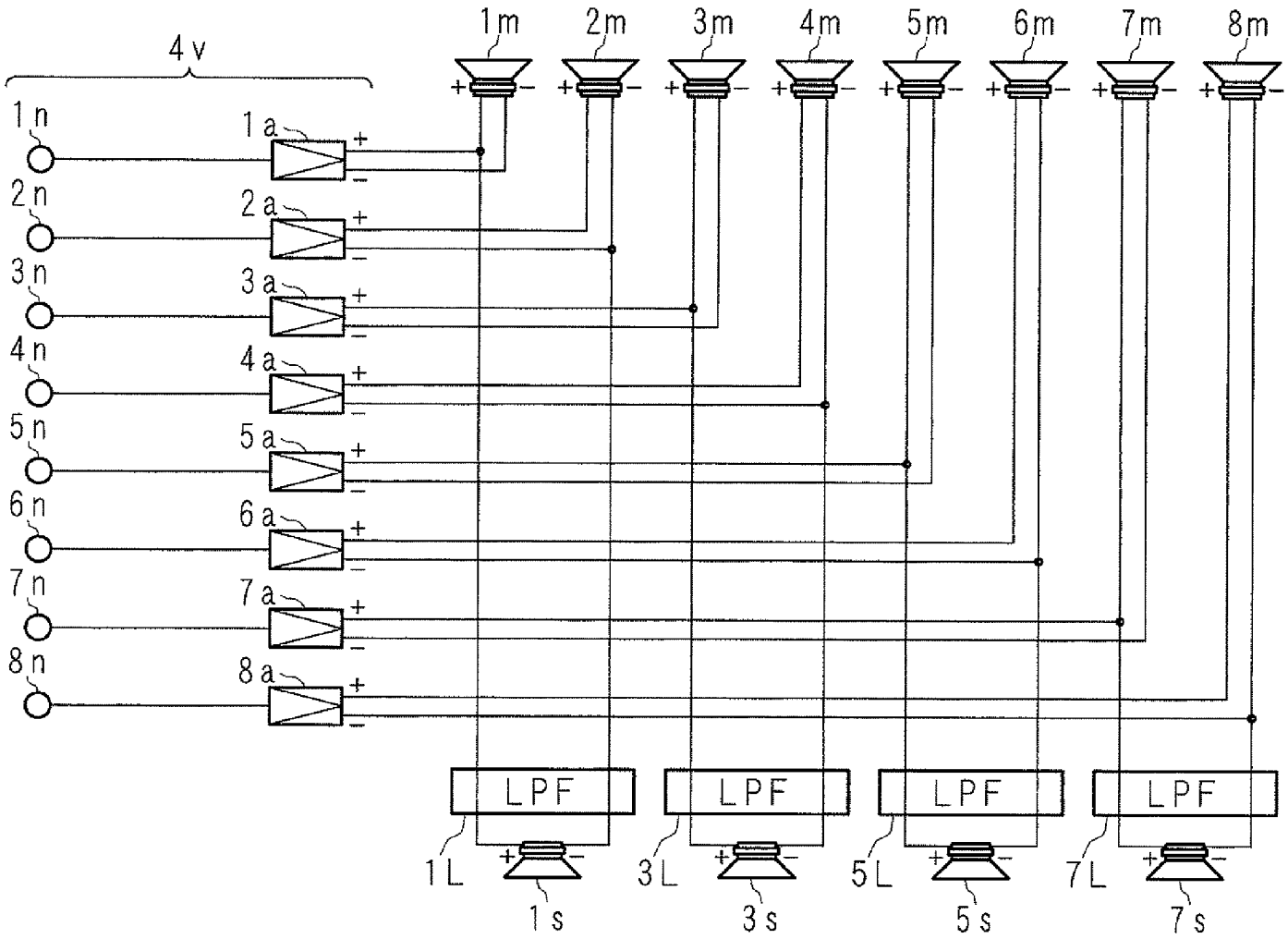
FIG. 9 is a block diagram illustrating an example of overall configuration of an array speaker and an array speaker driving part in a case that band limit is placed on the frequencies of signals to be provided to sub-speakers.

FIG. 9 is a block diagram illustrating an example of overall configuration of the array speaker and the array speaker driving part in a case that band limit is placed on the frequencies of signals to be provided to the sub-speakers.

In FIG. 9, the array speaker driving part 4*v* is a unit contained in the amplification part 4 illustrated in FIG. 3. Low pass filters 1L, 3L, 5L, and 7L are inserted between the sub-speakers 1*s*, 3*s*, 5*s*, and 7*s* and the amplifiers 1*a* to 8*a* so that band limit is performed. That is, when the frequencies of the signals to be transmitted to the sub-speakers 1*s*, 3*s*, 5*s*, and 7*s* are limited into values lower than or equal to the frequency fz, that is, when frequencies higher than the frequency fz are attenuated, a situation is avoided that sound waves including high frequency components disturbing the wavefront of the sound are emitted from the sub-speakers 1*s*, 3*s*, 5*s*, and 7*s*. In particular, when low-frequency speakers having different characteristics from the main speakers 1*m* to 8*m* are employed as the sub-speakers 1*s*, 3*s*, 5*s*, and 7*s*, such band limit is effective in avoiding both the problem of speaker interval and the problem of reproduction band.

Embodiment 2

Figure 10:
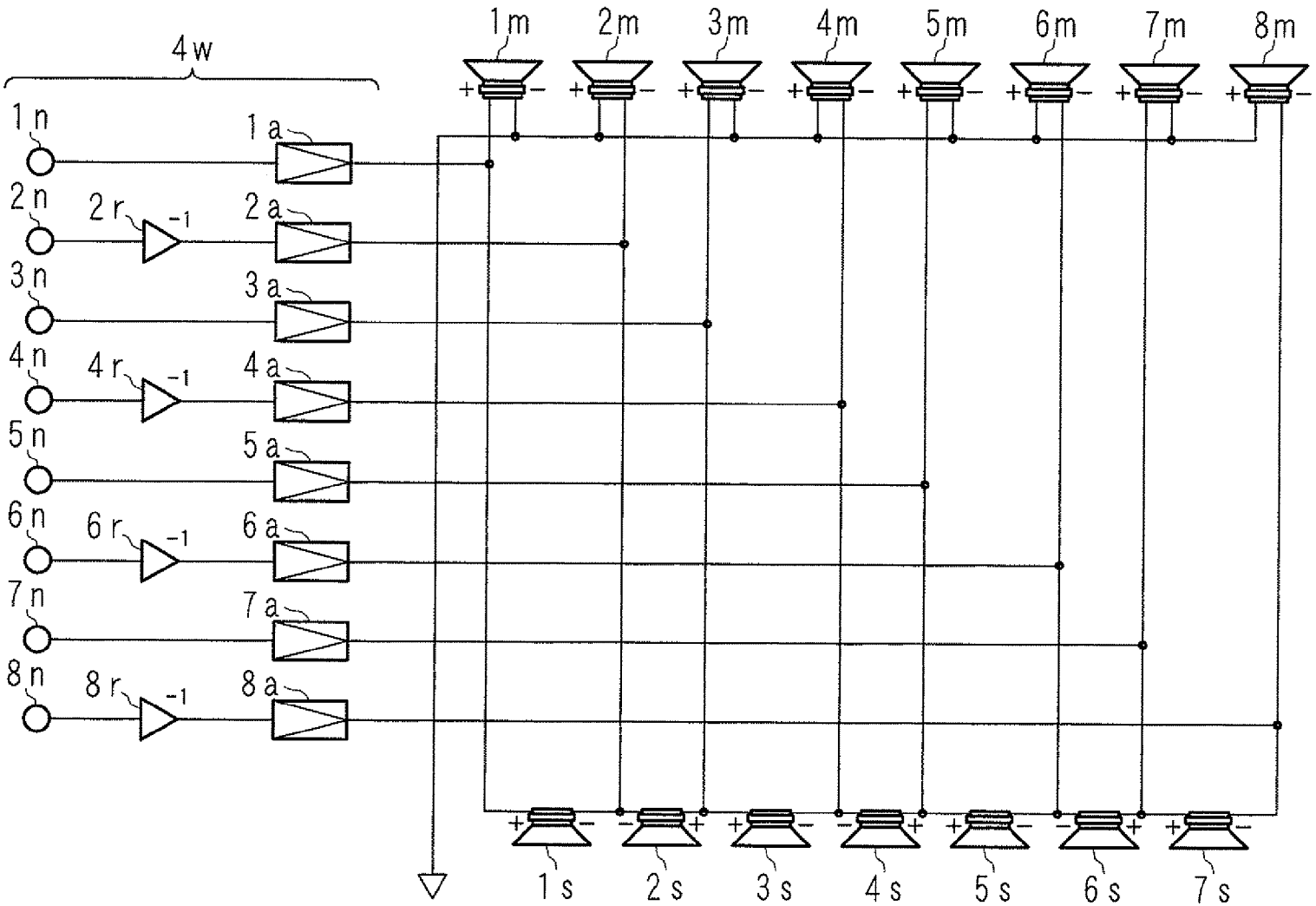
FIG. 10 is a block diagram illustrating an example of overall configuration of an array speaker and an array speaker driving part according to Embodiment 2.

FIG. 10 is a block diagram illustrating an example of overall configuration of an array speaker and an array speaker driving part according to Embodiment 2.

An array speaker driving part 4*w* is a unit contained in the amplification part 4 illustrated in FIG. 3 and has the function of supplying electricity to main speakers 1*m* to 8*m* and sub-speakers 1*s* to 7*s*. The array speaker driving part 4*w* has eight input terminals 1*n* to 8*n*, four phase inverters 2*r*, 4*r*, 6*r*, and 8*r*, and eight amplifiers 1*a* to 8*a*. The input terminals 1*n*, 3*n*, 5*n* and 7*n* are connected respectively to the amplifiers 1*a*, 3*a*, 5*a* and 7*a*. Then, the amplifiers 1*a*, 3*a*, 5*a* and 7*a* are connected respectively to the corresponding main speakers 1*m* to 8*m* and sub-speakers 1*s* to 7*s*. On the other hand, the input terminals 2*n*, 4*n*, 6*n*, and 8*n* are respectively connected through the phase inverters 2*r*, 4*r*, 6*r*, and 8*r* to the amplifiers 2*a*, 4*a*, 6*a*, and 8*a*. Then, the amplifiers 1*a* to 8*a* are connected respectively to the corresponding main speakers 1*m* to 8*m* and sub-speakers 1*s* to 7*s*. Here, the negative terminals of the main speakers 1*m*, 3*m*, 5*m*, and 7*m* and the positive terminals of the main speakers 2*m*, 4*m*, 6*m*, and 8*m* are grounded to the ground.

The connection relation of the amplifiers 1*a* to 8*a* and the speakers 1*m* to 8*m* and 1*s* to 7*s* is described below in further detail. The output terminals of the amplifiers 1*a*, 3*a*, 5*a*, and 7*a* are connected to the positive terminals (+) of the main speakers 1*m*, 3*m*, 5*m*, and 7*m* and the sub-speakers 1*s* to 7*s*. The output terminals of the amplifiers 2*a*, 4*a*, 6*a*, and 8*a* are respectively connected to the negative terminals (−) of the main speakers 2*m*, 4*m*, 6*m*, and 8*m* and the negative terminals (−) of the sub-speakers 1*s* to 7*s*.

The input terminals 1*n* to 8*n* receive the eight input signals obtained by the processing performed by the signal processing part 3 described above. Then, the received eight input signals are provided respectively to the corresponding amplifiers 1*a* to 8*a* or the corresponding phase inverters 2*r*, 4*r*, 6*r*, and 8*r*.

The phase inverters 2*r*, 4*r*, 6*r*, and 8*r* invert the phases of the input signals provided through the input terminals 2*n*, 4*n*, 6*n*, and 8*n*.

The amplifiers 1*a*, 3*a*, 5*a* and 7*a* amplify the input signals received through the input terminals 1*n*, 3*n*, 5*n* and 7*n* and then provide the obtained signals to the main speakers 1*m* to 8*m* and the sub-speakers 1*s* to 7*s*.

On the other hand, the amplifiers 2*a*, 4*a*, 6*a*, and 8*a* amplify the signals provided from the phase inverters 2*r*, 4*r*, 6*r*, and 8*r* and then provide the obtained signals to the main speakers 1*m* to 8*m* and the sub-speakers 1*s* to 7*s*. Then, the main speakers 1*m* to 8*m* and the sub-speakers 1*s* to 7*s* emit sound waves in response to the provided signals.

In FIG. 10, the phase inverters 2*r*, 4*r*, 6*r*, and 8*r* are provided in correspondence to the input terminals 2*n*, 4*n*, 6*n*, and 8*n*. The amplifiers 1*a*, 3*a*, 5*a*, and 7*a* output signals obtained by amplification in the same phases as the input signals with reference to the reference voltage. The amplifiers 2*a*, 4*a*, 6*a*, and 8*a* output signals obtained by conversion and amplification into the opposite phases to the input signals with reference to the reference voltage. That is, the amplifiers 1*a*, 3*a*, 5*a*, and 7*a* are connected to the positive terminals (+) of the main speakers 1*m*, 3*m*, 5*m*, and 7*m* and hence provide the signals of the same phases to the main speakers 1*m*, 3*m*, 5*m*, and 7*m*. On the other hand, the amplifiers 2*a*, 4*a*, 6*a*, and 8*a* are connected to the negative terminals (−) of the main speakers 2*m*, 4*m*, 6*m*, and 8*m* and hence provide the signals of phases reverse to those of the signals provided to the main speakers 1*m*, 3*m*, 5*m*, and 7*m*. Thus, when signals of the same phases are inputted to the input terminals 1*n* to 8*n*, the main speakers 1*m* to 8*m* emits wavefronts of the sound on the basis of the signals of the same phases.

That is, the amplifier 1*a* amplifies the input signal from the input terminal 1*n* and then transmits the obtained signal to the positive terminal (+) of the main speaker 1*m*. On the other hand, the amplifier 2*a* amplifies the input signal having undergone phase inversion performed by the phase inverter 2*r* and then transmits the obtained signal to the negative terminal (−) of the main speaker 2*m*. Thus, the main speaker 2*m* operates in the same phase as the signal transmitted to the main speaker 1*m*. Further, the amplifiers 2*a*, 4*a*, 6*a*, and 8*a* transmit signals of reverse phases to the negative terminals (−) of the sub-speakers 1*s* and 2*s*, 3*s* and 4*s*, 5*s* and 6*s*, and 7*s*. That is, the positive terminals (+) and the negative terminals (−) of the sub-speakers 1*s* to 7*s* are driven respectively with mutually different signals.

The positive terminal (+) of the main speaker 1*m* and the negative terminal (−) of 2*m* are driven in mutually opposite phases. Thus, the sub-speaker 1*s* receives the driving voltage of the main speaker 1*m* and the driving voltage of the main speaker 2*m*. This situation is equivalent to that the addition value of the driving voltages of the main speakers 1*m* and 2*m* is applied.

As such, in the eight main speakers 1*m* to 8*m*, the seven sub-speakers 1*s* to 7*s* at the maximum are added. Then, each of the sub-speakers 1*s* to 7*s* receives the addition value of the driving voltages applied to each adjacent two of the main speakers 1*m* to 8*m*. By virtue of this, the sub-speakers 1*s* to 7*s* are allowed to be arranged in such a manner that the wavefronts generated by the main speakers 1*m* to 8*m* are interpolated. The signals provided to the sub-speakers 1*s* to 7*s* are interpolation signals. Thus, the array speaker 1 constructed from the main speakers 1*m* to 8*m* and the sub-speakers 1*s* to 7*s* achieves synthesis of a wavefront closer to the desired wavefront in comparison with a case of parallel drive or series drive of the main speakers 1*m* to 8*m*.

By virtue of this, similarly to Embodiment 1, in the 15 speakers 1*m* to 8*m* and 1*s* to 7*s*, an acoustic system is realized by employing the signal processing part 3 for eight channels and the amplifiers 1*a* to 8*a* for eight channels. Then, even when the number of speakers 1*s* increased, an increase is avoided in the amount of hardware of the signal processing part 3 and the amplification part 4. Further, the amplifiers 1*a* to 8*a* not in balance drive are employed and hence as few as nine wirings are sufficient for connecting the speakers 1*m* to 8*m* and 1*s* to 7*s*. This reduces the construction cost of the acoustic system. Here, phase inverters are fabricated at remarkably low cost. Thus, even when the phase inverters are employed, the cost is hardly affected.

Here, each of the sub-speakers 1*s* to 7*s* receives the signals of two lines of the main speakers 1*m* to 8*m* and hence receives twice the voltage applied to each of the main speakers 1*m* to 8*m*. Thus, even when the main speakers 1*m* to 8*m* have the same impedances as the sub-speakers 1*s* to 7*s*, electricity higher than that to the main speakers 1*m* to 8*m* is supplied to the sub-speakers 1*s* to 7*s*. When low-frequency speakers are employed as the sub-speakers 1*s* to 7*s*, since low-frequency speakers generally have a lower efficiency, higher electricity need be supplied to the low-frequency speakers. Then, since the higher voltages are provided to the low-frequency speakers, speakers having high impedances are allowed to be employed. This reduces current capacities necessity in the amplifiers.

Further, when a configuration is employed that a sub-speaker is connected in parallel to a particular main speaker, the current capacity of the amplifier need be enhanced. Thus, in a case that this configuration and a configuration that a sub-speaker is not connected in parallel to a main speaker are employed in a mixed form, variation arises in the currents of the circuits of the individual main speakers. Thus, when the array speaker 1*s* to be driven with amplifiers of the same type, a loss arises in the current capacities of the amplifiers not adopting the configuration that a sub-speaker is connected in parallel to a main speaker. However, according to the present embodiment, this variation in the current capacities is reduced and hence the cost of the amplifiers is reduced.

Further, each of the sub-speakers 1*s* to 7*s* receives the addition signal of two lines of the main speakers 1*m* to 8*m*.

Thus, in a case that each of the sub-speakers 1*s* to 7*s* has an impedance equal to 4-fold of the impedance of each of the main speakers 1*m* to 8*m*, the same amount of electricity is supplied respectively to the main speakers 1*m* to 8*m* and the sub-speakers 1*s* to 7*s* connected to each other when the same signal is inputted to the input terminals 1*n* to 8*n*. When the main speakers 1*m* to 8*m* and the sub-speakers 1*s* to 7*s* have mutually similar characteristics and parameters other than the impedances, the main speakers 1*m* to 8*m* and the sub-speakers 1*s* to 7*s* have mutually similar apparent performance. This is effective in interpolating the wavefronts. Further, at that time, the current provided to each of the sub-speakers 1*s* to 7*s* is approximately half the current provided to each of the main speakers 1*m* to 8*m*. Thus, a remarkable increase is unnecessary in the current capacities of the amplifiers.

Figure 11:
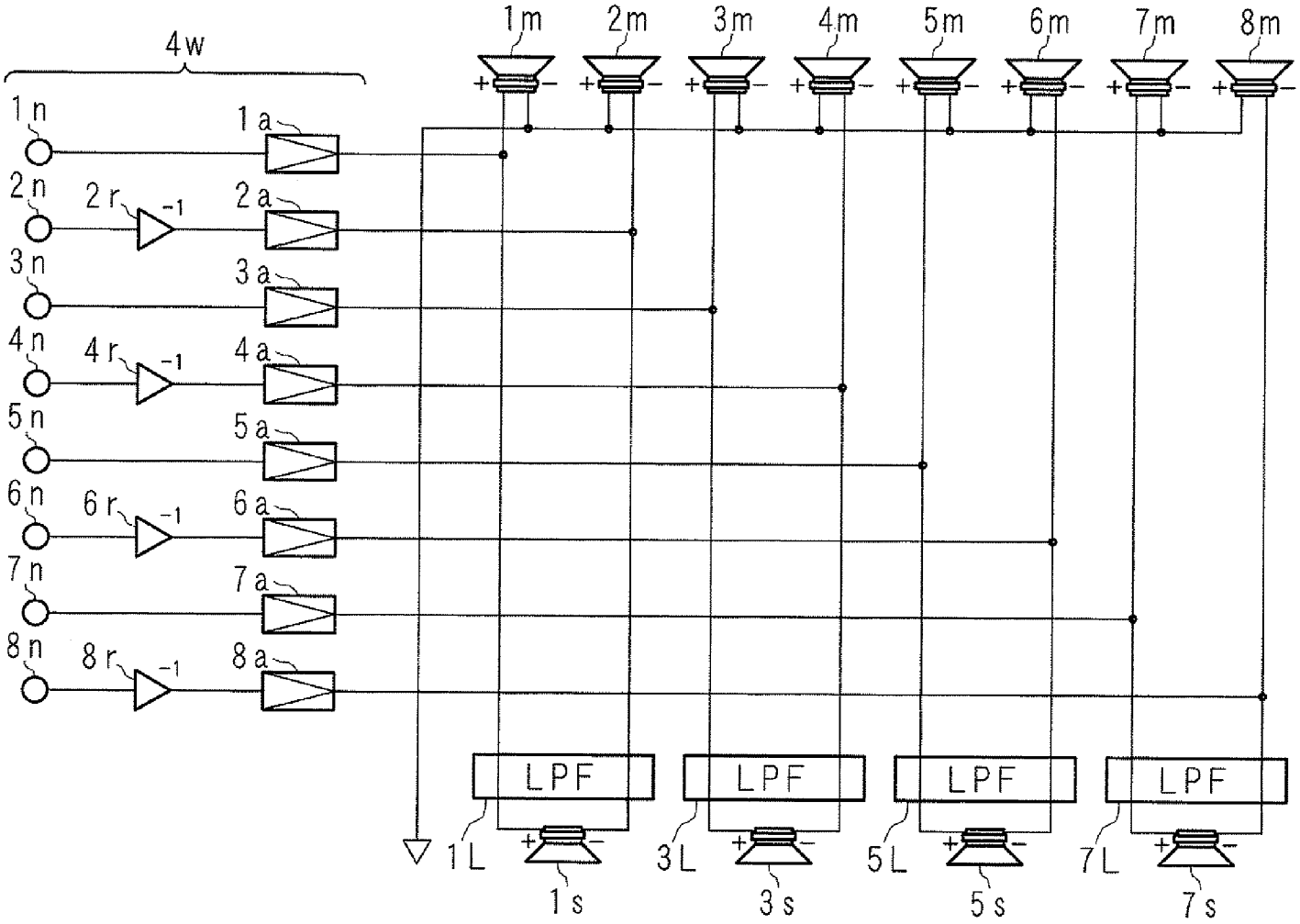
FIG. 11 is a block diagram illustrating an example of overall configuration of an array speaker and an array speaker driving part in a case that band limit is placed on the frequencies of signals to be provided to sub-speakers.

FIG. 11 is a block diagram illustrating an example of overall configuration of the array speaker and the array speaker driving part in a case that band limit is placed on the frequencies of signals to be provided to the sub-speakers.

In FIG. 11, the array speaker driving part 4*w* is a unit contained in the amplification part 4 illustrated in FIG. 3. Similarly to Embodiment 1, low pass filters 1L, 3L, 5L, and 7L are inserted between the sub-speakers 1*s*, 3*s*, 5*s*, and 7*s* and the amplifiers 1*a* to 8*a* so that band limit is performed. Here, the negative terminals of the main speakers 1*m*, 3*m*, 5*m*, and 7*m* and the positive terminals of the main speakers 2*m*, 4*m*, 6*m*, and 8*m* are grounded to the ground.

Here, similarly to Embodiment 1, Embodiment 2 is applicable also to the configuration of the array speaker illustrated in FIG. 7. That is, the configuration may be employed that the main speakers and the sub-speakers are arranged in two rows.

Modifications

In addition to Embodiments 1 and 2, the present invention may be applied to other modes. A few modes are illustrated below as modifications.

Embodiments 1 and 2 have been described for an exemplary case that wavefronts are outputted for eight input signal lines. However, an arbitrary number of input signal lines may be employed.

In Embodiments 1 and 2, in the eight input signal lines, the eight main speakers 1*m* to 8*m* and the seven sub-speakers 1*s* to 7*s* have been connected. However, when the number of input signals is n, main speakers of an arbitrary number up to n lines and sub-speakers of an arbitrary number up to n−1 lines may be connected.

In Embodiments 1 and 2, one speaker is connected to each main speaker. However, a plurality of speakers may be connected. At that time, the speakers to be connected may be of the same type or alternatively may be of mutually different types.

In Embodiments 1 and 2, WFS has been employed as an example of a wavefront synthesizing method. However, a method other than WFS may be employed.

In Embodiments 1 and 2, a configuration has been employed that the speakers are arranged in straight lines. However, the speakers may be arranged not in straight lines and may be arranged in two dimensions. In this case, similarly, the terminals of each sub-speaker are connected to the terminals of the nearest two different main speakers.

As this invention may be embodied in several forms without departing from the sprit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An acoustic system employing an array speaker including at least three speakers, comprising:

two input terminals receiving signals respectively corresponding to two second speakers adjacent to one first speaker; and a drive unit driving the two second speakers on the basis of the signals inputted through the two input terminals, wherein positive terminals provided respectively in the two second speakers are connected respectively to two positive terminals of the drive unit corresponding to the two second speakers and negative terminals provided respectively in the two second speakers are connected respectively to two negative terminals of the drive unit corresponding to the two second speakers, wherein a positive terminal provided in the one first speaker is connected to the positive terminal provided in one second speaker and a negative terminal provided in the one first speaker is connected to the negative terminal provided in the other second speaker, and wherein the positive terminals and the negative terminals of the drive unit transmit a signal having a same amplitude and a reverse phase relative to a reference voltage.

2. The acoustic system according to claim 1, wherein the one first speaker is located at equal distances from the two second speakers.

3. An acoustic system employing an array speaker including at least three speakers, comprising:

two input terminals receiving signals respectively corresponding to two second speakers adjacent to one first speaker;

a drive unit driving the two second speakers on the basis of the signals inputted through the two input terminals; and a circuit inserted between any one of the terminals provided in any one of the two second speakers and the input terminal corresponding to the terminal and inverting a phase of any one of the signals inputted to the two input terminals, wherein a positive terminal provided in the one first speaker is connected to a positive terminal provided in one second speaker and a negative terminal provided in the one first speaker is connected to the negative terminal provided in the other second speaker, wherein a driving signal outputted based on the signal inputted to one of the two input terminals is applied to the positive terminal provided in the one first speaker and the positive terminal provided in the one second speaker, and a driving signal outputted based on the signal inputted to the other of the two input terminals is applied to the negative terminal provided in the one first speaker and the negative terminal provided in the other second speaker, and wherein the positive terminals and the negative terminals of the drive unit transmit a signal having a reverse phase relative to a reference voltage.

4. The acoustic system according to claim 3, wherein the one first speaker is located at equal distances from the two second speakers.

5. The acoustic system according to claim 3, wherein the one first speaker has an impedance equal to 4-fold of an impedance of each of the two second speakers.

6. An acoustic system employing an array speaker including at least three speakers, comprising:

a plurality of second speakers arranged in one row;

one or a plurality of first speakers provided in a number smaller than the number of the plurality of second speakers and arranged in a row different from the plurality of second speakers;

two input terminals receiving signals respectively corresponding to two second speakers adjacent to one first speaker; and a drive unit driving the two second speakers on the basis of the signals inputted through the two input terminals, wherein positive terminals provided respectively in the two second speakers are connected respectively to two positive terminals of the drive unit corresponding to the two second speakers and negative terminals provided respectively in the two second speakers are connected respectively to two negative terminals of the drive unit corresponding to the two second speakers, wherein a positive terminal provided in the one first speaker is connected to the positive terminal provided in one second speaker and a negative terminal provided in the one first speaker is connected to the negative terminal provided in the other second speaker, and wherein the positive terminals and the negative terminals of the drive unit transmit a signal having a same amplitude and a reverse phase relative to a reference voltage.

7. The acoustic system according to claim 6, wherein the one first speaker is located at equal distances from the two second speakers.

* * * * *